United States Patent [19]

Cigarini et al.

[11] Patent Number: 4,998,001

[45] Date of Patent: Mar. 5, 1991

[54] METHOD AND DEVICE FOR TREATING A FROZEN FOOD IN A MICROWAVE OVEN

[75] Inventors: Enzo Cigarini, Brebbia; Franciscus Kokkeler, Malnate; Gigliana Orlandi, Sumirago; Laura Crepaldi, Biandronno, all of Italy

[73] Assignee: Whirlpool International B.V., Eindhoven, Netherlands

[21] Appl. No.: 409,483

[22] Filed: Sep. 19, 1989

[30] Foreign Application Priority Data

Sep. 23, 1988 [IT] Italy ..... 22063 A/88

[51] Int. Cl.[5] ..... H05B 6/68

[52] U.S. Cl. ..... 219/10.55 M; 219/10.55 B; 219/10.55 E; 99/325; 426/243; 426/524

[58] Field of Search ..... 219/10.55 M, 10.55 B, 219/10.55 E, 10.55 F, 518; 99/DIG. 14, 451, 325; 426/241, 243, 523, 524

[56] References Cited

U.S. PATENT DOCUMENTS

| | | | |
|---|---|---|---|
| 4,093,841 | 6/1978 | Dills | 219/10.55 E |
| 4,125,752 | 11/1978 | Wegener | 219/10.55 E |
| 4,341,937 | 7/1982 | Staats | 219/10.55 M |
| 4,434,342 | 2/1984 | Schubring | 219/10.55 B |
| 4,488,026 | 12/1984 | Tanabe | 219/10.55 B |
| 4,814,570 | 3/1989 | Takizaki | 219/10.55 B |
| 4,831,239 | 5/1989 | Ueda | 219/518 |
| 4,874,928 | 10/1989 | Kasai | 219/518 |

*Primary Examiner*—Philip H. Leung
*Attorney, Agent, or Firm*—Ernestine C. Bartlett

[57] ABSTRACT

A method for treating, i.e. thawing, thawing and heating, or thawing and cooking, a frozen food (9) in a microwave oven (1) is provided comprising a microwave generator or magnetron (2), characterized in that the food (9) is interposed between the magnetron (2), initially operating at constant power, and an element (14) of microwave-sensitive material, the temperature (T) of the element (14) varying during the thawing of the food (9), the temperature (T) variation being monitored by a microprocessor circuit (21) which on the basis thereof evaluates the weight of the food (9). The microprocessor (21) then, on the basis of this evaluated weight and fed information regarding the type of food (9) and required type of treatment, determines the operating power of the magnetron (2) and the treatment duration.

18 Claims, 2 Drawing Sheets

METHOD AND DEVICE FOR TREATING A FROZEN FOOD IN A MICROWAVE OVEN

FIELD OF THE INVENTION

This invention relates to a method for treating a frozen food in a microwave oven.

BACKGROUND OF THE INVENTION

In general in a microwave oven provided with a microprocessor controlling the operation of the microwave generator or magnetron, the food treatment (thawing, thawing plus heating, or thawing plus cooking) can be preplanned by the user by setting the food weight, the food type and the required type of treatment. These data enable the microprocessor to control the magnetron operation for the time required to obtain the desired treatment.

In known microwave ovens the food weight is determined for example by placing the food on a support to which a weight measurement device or more simply balance is connected. The balance thus enables the food weight to be automatically fed to the microprocessor by merely placing the food in the oven. Such a system is such used. It has however many drawbacks including the high cost of the components and the fact that the weighing device is a very sensitive and delicate mechanism which means that it can be easily damaged during the insertion of the food into the oven and its withdrawal therefrom.

SUMMARY OF THE INVENTION

An object of the present invention is to provide a method and device for treating a frozen food in a microwave oven by which the food weight is determined without the use of weighing devices or the like installed in the oven. Another object of the invention is to determine said food weight by using the relationship between the water present in the food and its weight.

A further object of the present invention is to enable the food weight to be determined by measuring the quantity of water present in the food.

These and further objects which will be apparent to the expert of the art are attained by a method for treating, i.e. thawing, thawing and heating, or thawing and cooking, a frozen food in a microwave oven comprising a microwave generator or magnetron, characterized in that the food is interposed between the magnetron, initially operating at constant power, and an element of microwave-sensitive material, the temperature of said element varying during the thawing of said food, said temperature variation being monitored by a microprocessor circuit which on the basis thereof evaluates the food weight, said microprocessor then, on the basis of this evaluated weight and fed information regarding the type of food and required type of treatment, determining the operating power of the magnetron and the treatment duration.

It has been surprisingly found that the heating curve of the element of microwave-sensitive material within a limited time period (t) from application of the microwaves is a straight line for temperature/time, the slope of which varies according to the food weight (see FIG. 6).

It is apparent that if at the end of this time period (t) a measurement is made either of the slope of this straight line or the point of intersection with the temperature axis of a straight line parallel to the time axis and passing through the point which the temperature/time line has reached after the time period (t), the microprocessor circuit receives information corresponding to the food weight and, on the basis of this and taking into account the information fed in by the user regarding the food type and the required treatment, is able to determine the magnetron operating power, the treatment duration and the treatment modality.

BRIEF DESCRIPTION OF THE DRAWINGS

The present invention will be more apparent from the accompanying drawing, which is provided by way of non-limiting example only and in which.

DETAILED DESCRIPTION OF PREFERRED EMBODIMENTS

Figure 1:
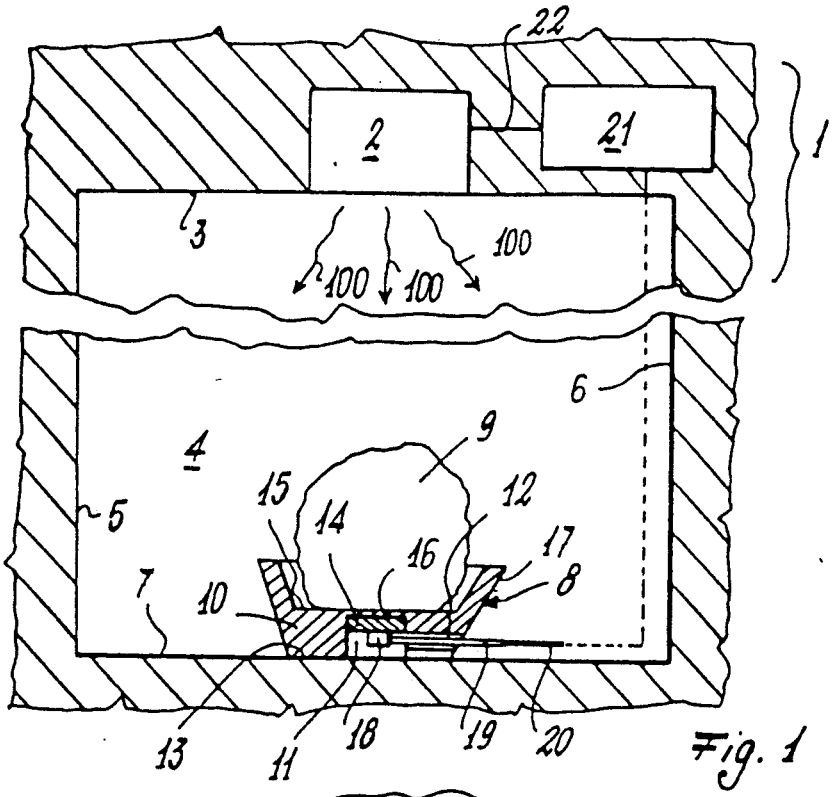
FIG. 1 is a partial diagrammatic section through a microwave oven in which the method of the present invention is implemented.

In FIGS. 1 to 4, a microwave oven indicated overall by the reference numeral 1 comprises a microwave generator or magnetron 2 disposed in the roof 3 of a cooking chamber 4 having side walls 5 and 6 and a bottom wall or base 7.

A support or plate 8, for example of ceramic, terracotta or the like, for a food 9 rests on the base 7. In the bottom part 10 of the support there are provided (see FIG. 1) two communicating cavities 11 and 12 with their axes mutually orthogonal.

The cavity 11, which opens at its lower end into the resting surface 13 of the plate 8, contains an element 14 constructed of a microwave-sensitive material (such as ferrite). This element is not in contact with the food 9, it being separated from the supporting surface 15 of the plate 8 by a separating part 16 and being retained in the cavity 11 by known means, such as adhesives. The cavity 12 extends radially within the bottom part 10 of the plate 8. The cavity 12 opens at one end into a wall 17 of said plate and at its other end into the cavity 11 containing the element 14.

A transducer for a signal operationally related to the temperature of the element 14 is associated with said element. In the examples described herein said transducer is a known temperature sensor 18 supported by a hollow rod-shaped element or rod 19. During the first stage of the method of the invention, i.e. during initial thawing of the food 9, the sensor 18 is positioned below the element 14 and in contact with it, the rod 19 present in the cavity or corridor 12 projecting at one end from the plate 8. The rod 19 contains the terminal part of an electrical connector 20 for connecting the sensor 18 to a known microprocessor circuit 21 (hereinafter known simply as the microprocessor) which is able to act on the microwave generator 2 by way of an electrical connection 22.

Figure 6:
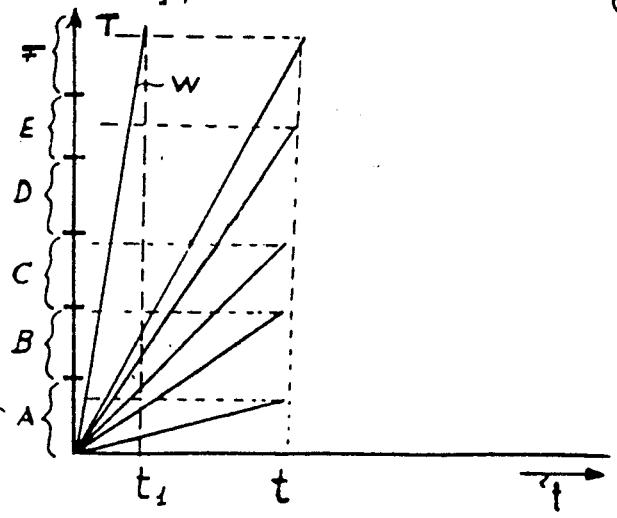
FIG. 6 is a time-temperature curve showing the variation in temperature of a microwave-sensitive element used in the method of the invention, during the presence of identical foods of different weight or of different foods of identical weight in the oven of FIG. 1.

The treatment method (thawing, thawing plus heating or thawing plus cooking of a frozen food) according to the present invention is described hereinafter in relation to the said oven 1 comprising the element 14 of microwave-sensitive material and the sensor 18, and with reference to FIG. 6.

It will be assumed that a food 9, for example meat, positioned on the plate 8 is to be thawed and cooked, for which purpose the magnetron 2 is initially switched on in known manner by the user, for example by means of a pushbutton on the face of the oven 1. The user then sets the type of food (in this case meat) and the type of treatment (thawing and cooking). Operating said pushbutton causes the microprocessor 21 to operate the magnetron 2 at a certain constant power (for example half power) and known hereinafter as the test power, for a short time period (t), for example 10–15 seconds, known hereinafter as the test period. A fraction of the microwaves 100 passes through the food 9 without undergoing absorption thereby to strike the element 14 below the food, which therefore heats up.

This heating is sensed by the sensor 18 which feeds the received data to the microprocessor 21. This then compares said data with that already fed into its memory for different rates of heating of the element 14 obtained experimentally by subjecting said element, for a time equal to said test period, to the microwaves generated by a magnetron operating at the test power. These data were obtained specifically by interposing frozen foods of different weight and type (such as meat, fish, vegetables, flour products) between the element 14 and said magnetron. It was surprisingly noted that the rate at which the temperature of the element 14 varies is a function of the weight of the food under which it is disposed. This fact is apparent in FIG. 6 from the various curves or straight lines present in this figure and their different slopes (representing the rate of heating of the element 14) or the different points of intersection with the temperature axis of a straight line parallel to the time axis which passes through the points on said curves at the end of the test period (t). Groups of straight lines similar to those of FIG. 6 were also obtained for the same food by varying its weight.

With regard to the oven of FIG. 1, as stated the heating data for the element 14 are obtained by the sensor 18 and fed to the microprocessor 21. By comparing the relative data with the data already stored in it and taking into consideration the food type as fed in by the user, the microprocessor 21 is able to obtain the weight of said food 9 contained in the oven.

Advantageously (see FIG. 6), to obtain even better evaluation of the food weight the microprocessor extrapolates onto the temperature (T) axis the value at the end of the test period t on the curve or straight line representing the data obtained by the sensor 18. The temperature (T) axis is divided into predetermined intervals A, B, C, D, E, F at which the experimental temperature data extrapolated from the groups of straight lines at the end of the test period lie for each type of food which can be prepared in the oven. This extrapolation of the temperature data onto the T axis (as heretofore described) together with the information on the food type fed into the microprocessor by the user enables the microprocessor to determine the food weight with sufficient accuracy and thus operate the magnetron 2 at the power required to thaw and treat the food as required by the user (in the case under examination, thawing and cooking said food in accordance with a preset or at least partially preset program in the microprocessor. The parameters with which the microprocessor works are the magnetron operating power, the treatment duration and the power applied during the treatment, which can either be constant or can vary in accordance with suitable criteria to obtain the best cooking result).

Figure 2:
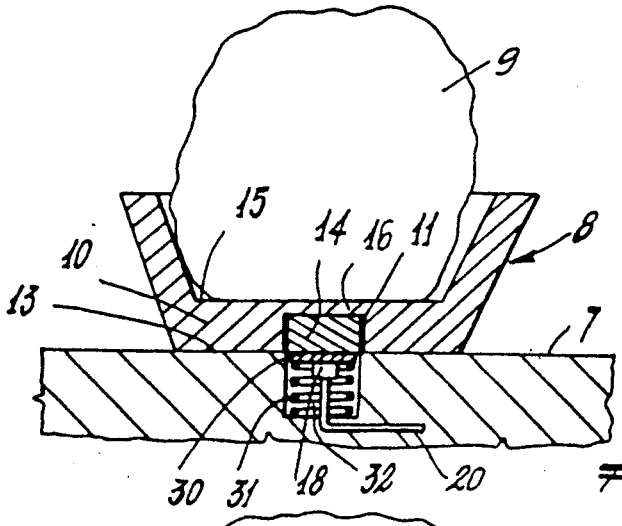
FIG. 2 is an enlarged section through a part of the oven of FIG. 1 constructed in a different manner from the corresponding part of FIG. 1.

FIG. 2 shows to an enlarged scale a different embodiment of the plate 8 and of those parts of the oven 1 adjacent to it, and illustrating a method of coupling the element 14 of microwave-sensitive material to the temperature sensor 18 which differs from that shown in FIG. 1. In FIG. 2 parts identical to those of FIG. 1 are indicated by the same reference numerals.

In the figure under examination, said element 14 is disposed in the cavity 11 of the plate 8 in a position below the food 9 and is retained in said cavity by known means. The temperature sensor 18 is disposed in the base 7 of the cooking chamber 4 of the oven 1 and is in contact with the element 14 projecting lowerly from said cavity 11. This contact can either be direct, or be indirect as shown in FIG. 2.

In this figure the sensor 18 is secured to the underside of a small-thickness metal plate 30, constructed of a good heat-conducting metal (such as aluminum or copper). The metal plate 30 is in constant contact with the element 14 by virtue of a spring 31 disposed in a cavity 32 provided in the base 7. In this manner the heat transmitted by conduction from the element 14 to the metal plate 30 is sensed by the sensor 18 and the temperature signal is fed to the microprocessor (not shown in FIG. 2) through the electrical connection 20.

Limit stops (not shown) are provided to prevent the plate 30 escaping from the cavity 32 as a result of the thrust exerted by the spring 31 when the plate 8 is removed. In addition, above the plate 30 in proximity to its edges gaskets of known type (not shown) are advantageously provided to prevent foreign matter such as food residues or the like entering the cavity 32 and possibly damaging the sensor 18 and/or hindering the action of the spring 31 on the plate 30.

The method using an oven 1 formed as shown in FIG. 2 is analogous to that described in relation to FIG. 1 and is therefore not further described.

It should be noted that with the plate 8 constructed as shown in FIG. 2, it can be easily extracted from the oven I, for example when it needs to be cleaned. In this respect, the user in extracting the plate 8 does not have to take into account the presence of the sensor 18 during this operation, as instead he must with the plate 8 formed as shown in FIG. 1. With reference to this latter figure the user must extract the rod 19 carrying the sensor 18 from the cavity 12 before he extracts the plate 8 from the oven 1, and this can cause problems particularly because of the small space in which the user has to work.

Figure 3:
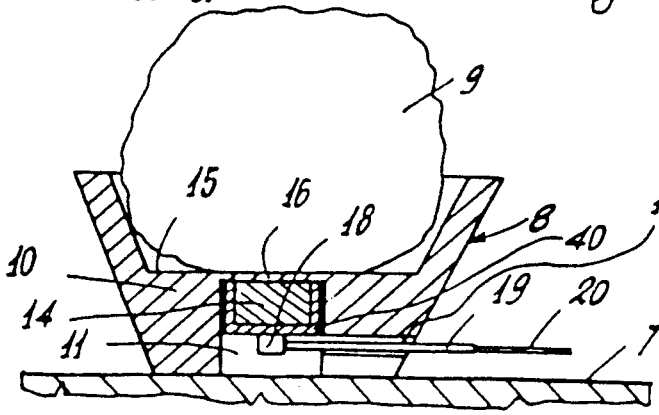
FIG. 3 is an enlarged section through a further embodiment of the oven part shown in FIG. 2.

A further embodiment of the plate 8 and of the coupling between the element 14 of microwave-sensitive material and the temperature sensor 18 is shown in FIG. 3. In this figure parts identical to those described in relation to FIGS. 1 and 2 carry the same reference numerals.

In this figure, the element 14 of microwave-sensitive material is inserted into a cup-shaped element 40 which surrounds it laterally and lowerly i.e., at its bottom and sides said cup-shaped element 40, which is thin-walled, is constructed of microwave-impermeable material (such as copper) having a high heat transfer coefficient. The element 40 therefore acts as a lateral and lower shield for said element 14. In this manner, this latter receives microwaves 100 only from the upper part of the plate 8, i.e. those microwaves which pass through the food 9 while this is still frozen. By virtue of this screening, the reflected microwaves which reach the plate 8 laterally and/or on its underside are not absorbed by the element 14 and do not heat it this heating being due only to those microwaves which pass through the food 9. This therefore eliminates any spurious effects which could falsify the action of the microprocessor 21 on the magnetron 2 during the implementation of the method according to the invention, this action being controlled as stated by the temperature data obtained by the sensor 18 which is positioned in contact with the underside of the cup-shaped element 40.

Figure 4:
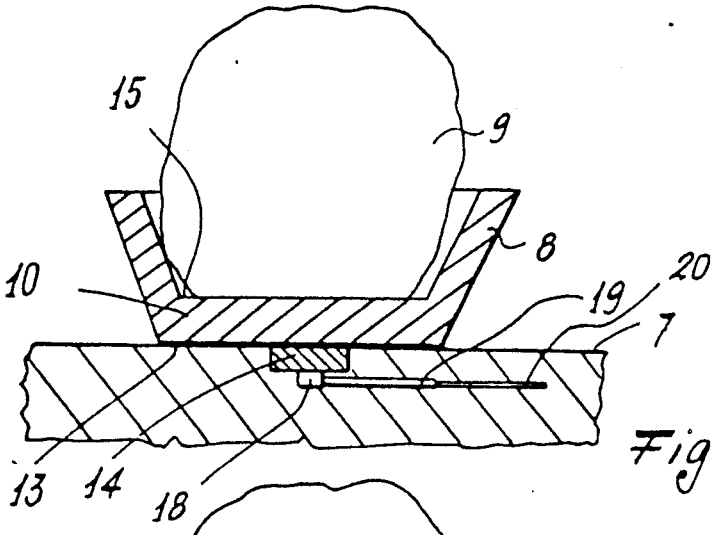
FIG. 4 is a diagrammatic section showing a further embodiment of the oven part of FIG. 2.
Figure 5:
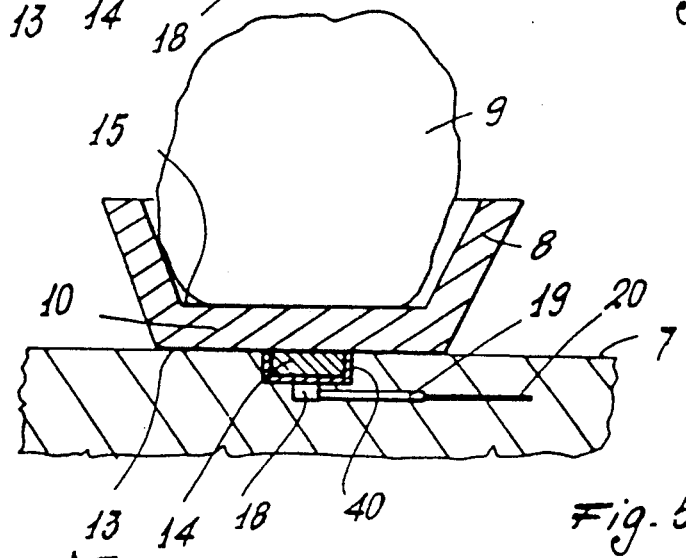
FIG. 5 is a diagrammatic section showing a further embodiment of the oven part of FIG. 2.

FIGS. 4 and 5 show two further embodiments of the plate 8 and two different methods of coupling the element 14 of microwave-sensitive material to the temperature sensor 18. In these figures parts identical to those described in relation to FIGS. 1, 2 and 3 carry the same reference numerals.

In FIGS. 4 and 5 the element 14 and its associated sensor 18 are both disposed in the base 7 of the cooking chamber 4 and are retained there by known means. In particular, in FIG. 5 the element 14 of microwave-sensitive material is inserted in the cup-shaped element 40 in the same manner and for the same purpose as already described in relation to FIG. 3.

The embodiments shown in FIGS. 4 and 5 allow an even simpler use of an oven arranged for implementing the method of the present invention. In this respect, the user is able to use in this oven a normal plate 8 instead of having to use a plate of the type illustrated in FIGS. 1, 2 and 3. The implementation of the method in an oven of the type shown in FIGS. 4 and 5 is in any event analogous to that described with reference to FIG. 1, and will therefore not be further described.

In the aforegoing description the method of the present invention has been applied to an oven provided with a stationary plate 8. The method can however also be applied to ovens provided with a rotary plate 8.

In this latter case the transducer or temperature sensor 18 is housed for example in the known rotary shaft (or drive shaft) which supports the plate 8, the shaft for this purpose being made hollow to enable a hollow but stationary shaft to be inserted coaxially into it to carry at its end the sensor 18, which then does not rotate.

In this latter case, the plate 8 can again be of the type described with reference to FIGS. 4 and 5.

Finally, although the transducer 18 associated with the element 14 of microwave-sensitive material has been described herein as a temperature sensor, it can take the form of any transducer which on receiving the signal functionally related to the temperature attained by the element 14 is able to generate an electrical signal which enables the microprocessor 21 to control the operation of the magnetron 2 after calculating the food weight and after the user has set the food type and the required treatment. The device for implementing the method of the present invention comprising the element 14 of microwave-sensitive material can also be used to indicate that the magnetron has been set in operation in error, and thus as a warning device indicating that the magnetron 2 is operating without food 9 being present in the oven. It is well known that such a situation in which the magnetron operates without food 9 being present in the oven 1 can lead to overheating of the microwave generator 2. This is because the generated microwaves are not absorbed by food and are therefore reflected throughout the cooking chamber 4 by its walls and finally return to the magnetron 2, to be absorbed by this latter which consequently heats up.

The presence of the element 14 prevents this. In this respect, because there is no food 9 present to shield the element 14, this latter absorbs a considerable quantity of microwaves in a short period and therefore heats up very rapidly.

This rapid heating, sensed by the sensor 18 after a time (t), which is less than (t) (and shown on the temperature-time graph of FIG. 6 by a straight line W with a slope greater than that of the other straight lines shown in this figure), is then deemed by the microprocessor 21, suitably programmed for the purpose, to be due to the operation of the magnetron 2 without any food 9 being present in the chamber 4 of the oven 1. At this point the microprocessor 21 then halts the operation of the magnetron 2 before it overheats.

Said action of the microprocessor 21 on the microwave generator 2 occurs only a very short time after this latter has been set in operation, and in fact a considerable time before the intervention of the usual temperature sensors provided in the magnetron 2 for halting its operation under such conditions.

The described method is simple to implement for any type of food, and enables the oven to provide optimum and properly controlled food preparation.

We claim:

1. A method for treating a frozen food in a microwave oven comprising the steps of placing frozen food (9) in a support (8) in a microwave oven (1) comprising a microwave generator and exposing said food to microwaves (100) generated therein, the food (9) being interposed between the magnetron (2), initially operating at constant power, and an element (14) of material sensitive to the microwave (100), the temperature (T) of said element (14) varying during the thawing of said food (9), said temperature (T) variation being monitored by a microprocessor (21) which on the basis thereof evaluates the weight of the food (9), said microprocessor (21) then, on the basis of this evaluated weight and fed information regrading the type of food (9) and required type of treatment, determining the operating power of the microwave generator (2) and the treatment duration.

2. A method as claimed in claim 1, wherein the temperature (T) of the element (14) of microwave-sensitive material is measured by transducer means (18) which receive a signal operationally related to said temperature (T) and feed an electrical signal to the microprocessor circuit (21).

3. A method as claimed in claim 2, wherein the microprocessor circuit (21) compares the temperatures (T) measured by the transducer means (18) with stored temperature values relative to a range of food types and weights, said comparison taking into account the information which the user has fed into the microprocessor (21) regarding the type of food to be treated.

4. A method as claimed in claim 2, wherein the transducer means (18) are a temperature sensor.

5. A method as claimed in claim 1, wherein the microprocessor circuit (21) acts on the magnetron (2) after a time (t) during which the temperature (T) of the element (14) of microwave-sensitive material varies, said time (t) being between ten and twenty seconds.

6. A method as claimed in claim 1, wherein the microprocessor circuit (21) is programmed in such a manner as to act on and thus halt the magnetron (2) when the element (14) of microwave-sensitive material is found to undergo rapid temperature variation, this due to the magnetron being put into operation without any food (9) being resent in the oven (1).

7. A device for treating frozen food in a microwave oven, said device comprising a microwave oven (1) having a bottom wall (7), a cooking chamber (4) and a microwave generator (2), a support (8) for frozen food (9) to be treated therein, the support including at least one cavity, an element (14) constructed of a microwave-sensitive material, the temperature (T) of said element (14) varying during the thawing of said food (9), transducer means (18) which measures the temperature (T) of the element (14) and feeds and electrical signal to a microprocessor (21) which monitors the temperature (T) variations and on the basis thereof evaluates the weight of the food and on the basis of this evaluated weight and fed and stored information regarding the type of food and required type of treatment, determines the operating power of the microwave generator (2) and the treatment duration, the element (14) being associated with the support (8) and being in direct or indirect contact with the transducer means (18).

8. A device as claimed in claim 7, wherein the element (14) of microwave-sensitive material is inserted in a cavity (11) provided in the food support (8).

9. A device as claimed in claim 8, wherein the transducer means (18) are in contact with the element (14) in the cavity (11), said transducer means (18) being connected to a rod-shaped member (19) inserted through a radial cavity (12) in the support (8) for the food (9).

10. A device as claimed in claim 8, wherein the element (14) of microwave-sensitive material occupies the entire volume of the cavity (11) in the support (8) for the food (9), said element (14) cooperating with transducer means (18) attached to the bottom wall (7) of the cooking chamber (4) of the oven (1).

11. A device as claimed in claim 10, wherein the element (14) of microwave-sensitive material is in contact with a metal plate (30) urged by a spring (31) attached to the transducer means (18), said metal plate (30) being axially mobile in a cavity (32) provided in the bottom wall (7) of the cooking chamber (4).

12. A device as claimed in claim 7 wherein the element (14) of microwave-sensitive material is screened at its bottom and sides by a microwave-impermeable material.

13. A device as claimed in claim 12, wherein the element (14) of microwave-sensitive material is contained in a cup-shaped element (40).

14. A device as claimed in claim 7, wherein the element (14) of microwave-sensitive material and the transducer means (18) are both situated in the bottom wall (7) of the cooking chamber (4) of the oven (1).

15. A device as claimed in claim 7, wherein the support (8) for the food (9) is of stationary type.

16. A device as claimed in claim 7, wherein the support (8) for the food (9) is of rotary type.

17. A device as claimed in claim 16, wherein the transducer means (18) are disposed in a cavity provided in a drive shaft used for rotating the support (8) for the food (9), said transducer means (18) cooperating with the element (14) of microwave-sensitive material which is also disposed in the drive shaft cavity.

18. A device as claimed in claim 7, wherein the microwave generator is a magnetron (2) and the transducer means (18) are connected to a microprocessor circuit (21), said microprocessor circuit (21) controlling the operation of the magnetron (2) on the basis of the data measured by the transducer means, the information regarding the type of food (9) and required type of treatment, and the stored data, in order to obtain the required treatment for the food (9).

* * * * *